US007669386B2

(12) United States Patent
Liao et al.

(10) Patent No.: US 7,669,386 B2
(45) Date of Patent: Mar. 2, 2010

(54) APPARATUS AND METHOD FOR FILING CONTINUOUS AIR FILLING TYPE AIR ENCLOSURE WITH AIR

(75) Inventors: Chieh Hua Liao, 4F., No. 7, Lane 130, Mincyuan Rd., Sindian City, Taipei County (TW); Yaw Shin Liao, Sindian (TW); Yao Chuan Liao, Sindian (TW)

(73) Assignee: Chieh Hua Liao, Taipei County (TW)

( * ) Notice: Subject to any disclaimer, the term of this patent is extended or adjusted under 35 U.S.C. 154(b) by 0 days.

(21) Appl. No.: 12/050,490

(22) Filed: Mar. 18, 2008

(65) Prior Publication Data

US 2009/0077926 A1 Mar. 26, 2009

(30) Foreign Application Priority Data

Sep. 26, 2007 (TW) ..... 96135705 A

(51) Int. Cl.
*B65B 31/06* (2006.01)

(52) U.S. Cl. ..... 53/96; 53/89; 53/525

(58) Field of Classification Search ..... 53/403, 53/437, 79, 89, 95, 96, 52, 503, 525
See application file for complete search history.

(56) References Cited

U.S. PATENT DOCUMENTS

| | | | | |
|---|---|---|---|---|
| 5,261,466 | A | 11/1993 | Koyanagi | |
| 6,410,119 | B1 | 6/2002 | De Luca et al. | |
| 6,786,022 | B2 * | 9/2004 | Fuss et al. | 53/403 |
| 6,789,376 | B1 * | 9/2004 | Greenwood et al. | 53/79 |
| 7,165,375 | B2 * | 1/2007 | O'Dowd | 53/89 |
| 7,328,541 | B2 * | 2/2008 | Garceau et al. | 53/79 |
| 2006/0174589 | A1 * | 8/2006 | O'Dowd | 53/79 |
| 2006/0218880 | A1 * | 10/2006 | Sperry et al. | 53/403 |

* cited by examiner

*Primary Examiner*—Louis K Huynh
(74) *Attorney, Agent, or Firm*—Rabin & Berdo, P.C.

(57) ABSTRACT

An apparatus and method for filling a continuous air filling type air enclosure with air comprises moving first an air cylinder film sheet onto a working platform, hot-sealing two outer films of the air cylinder film sheet using a hot sealing device to form an air filling passageway, moving an air filling head into the air filling passageway and then using a clamping apparatus to press the two outer films tightly to attach onto the air filling head to allow air in the air filling head to be filled into the air filling passageway and enter an air cylinder of the air cylinder film sheet via an air inlet of the air cylinder film sheet to cause the air cylinder to be filled with air and expanded.

11 Claims, 15 Drawing Sheets

APPARATUS AND METHOD FOR FILING CONTINUOUS AIR FILLING TYPE AIR ENCLOSURE WITH AIR

CROSS-REFERENCES TO RELATED APPLICATIONS

This non-provisional application claims priority under 35 U.S.C. §119(a) on Patent Application No(s). 096135705 filed in Taiwan, R.O.C. on Sep. 26, 2007, the entire contents of which are hereby incorporated by reference.

FIELD OF THE INVENTION

The present invention relates to an apparatus and method for filling an air enclosure with air, and more particularly to an apparatus and method for filling a continuous air filling type air enclosure with air.

BACKGROUND

Generally, when an article is packed material is always stuffed between the article and the container, typically a soft material such as foam or Styrofoam to provide the article with protective cushioning. However, foam and Styrofoam cause environmental protection problems. As environmental consciousness is currently rising Styrofoam is not a suitable cushioning material.

To solve the problem mentioned above, an air packing bag made by hot-sealing two sheets of thin plastic film is made. This provides cushioning protection for a packed article while it is being shaken. Air bag packing largely constitutes a plurality of air cylinders independent of one another, where each air cylinder has its own independent air inlet. Inflation must be carried out on the air inlet of each air cylinder, so that the air filling process consumes much time.

Please refer to FIG. 13. An air filling head Al disclosed by U.S. Pat. No. 5,261,466 is stretched into two sheets of film A2 to carry out the air filling process by allowing air first to enter air filling passageway A3, and then to fill air cylinder A5 via air valve A4, causing air cylinder A3 to be filled with air and expanded. However, the two sheets of film are not attached to air filling head Al closely, causing the air filled through air filling head A1 to leak out. Not only is the air bag unable to be filled effectively, air cylinder A5 cannot be uniformly filled with air.

Please refer to FIG. 14. An air filling head A1 disclosed by U.S. Pat. No. 6,410,119 is stretched into two sheets of film A2 to carry out the air filling process by allowing air to enter air cylinder A5, filling it with air and expanding it, and a hot sealing roller A6 is used to hot-seal the two sheets of film A2 to seal air cylinder A5 after the air filling process is completed. However, air filling head A1 can only fill one single air cylinder (A5), at a time. This not only results in low air filling efficiency, but also renders the air filling process ineffective due to the fact that air may easily leak while the air filling process is carried out to, resulting in air cylinders A5 filled with air and expanded, but unable to bear a strong blow.

SUMMARY

The present invention is proposed to improve the process of filling an air packing bag with air, allowing the air to be filled with air continuously to save filling time and decreasing filling cost of the air packing bag.

An apparatus for filling a continuous air filling type air enclosure with air according to the present invention is used to fill an air cylinder film sheet with air. The air cylinder film sheet comprises two outer films, a plurality of air cylinders and a plurality of air inlets. The plurality of air cylinders are formed by adhering the two outer films to each other by means of hot sealing, and the plurality of air inlets are positioned on one end of the plurality of air cylinders. Each air inlet corresponds to an air cylinder. The air filling apparatus comprises:

a working platform, used for mounting the air cylinder film sheet;

an initial hot sealing seat, disposed on the working platform and used for hot-sealing the two outer films and forming an air filling passageway at one side of the air cylinders, the air filling passageway converging with the air cylinders through the air inlets;

an air filling head, used for conveying air into the air filling passageway; and a clamping apparatus, used for pressing the two outer films tightly to attach onto the air filling head to allow air in the air filling passageway to enter each air cylinder via each air inlet, causing each air cylinder to be filled with air and expanded.

The present invention also proposes a method for filling a continuous air filling type air enclosure with air, comprising the following steps:

obtaining air cylinder film sheet comprising two outer films, a plurality of air cylinders and a plurality of air inlets, the plurality of air cylinders being formed by adhering the two outer films to each other by means of hot sealing, the plurality of air inlets being placed at one end of the plurality of air cylinders and each air inlet corresponding to an air cylinder;

moving the air cylinder film sheet to the working platform;

moving an air filling head to a place between the two outer films;

hot-sealing the two outer films to form an air filling passageway at one side of the air cylinders converging with the air cylinders through the air inlets;

providing a clamping apparatus to press the outer films tightly to attach them to the air filling head;

filling the air cylinders continuously via the air inlets; and moving the air-filled air cylinders from the working platform.

The present invention integrates the manufacturing flow of the air filling passageway and the manufacturing flow of the air filling of the air cylinders to allow the two outer films to be adhered to each other by means of hot sealing, forming the plurality of air cylinders. The first hot sealing seat is then directly used to adhere the two outer films to each other by means of hot sealing to form the air filling passageway and in the meantime the air filling process can continue with the plurality of air cylinders. This not only saves air filling time, but also improves air filling efficiency of the air enclosure can be elevated and reduces labor cost filling the air enclosure.

BRIEF DESCRIPTION OF THE DRAWINGS

The present invention can be more fully understood by reference to the following description and accompanying drawings, in which.

DETAILED DESCRIPTION

Figure 1:
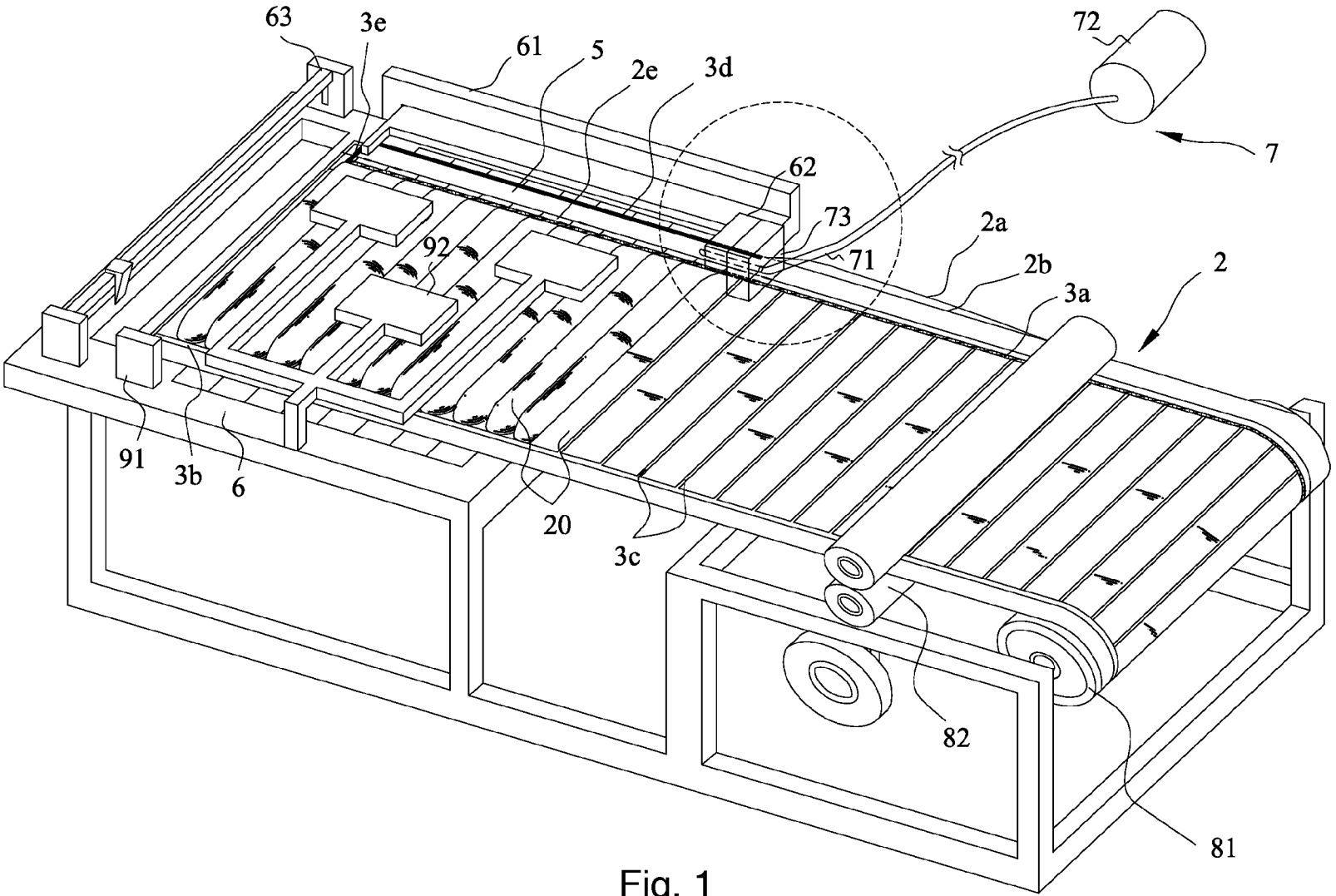
FIG. 1 is a perspective view, showing an apparatus for filling a continuous air filling type air enclosure with air of a first preferred embodiment according to the present invention.
Figure 2A:
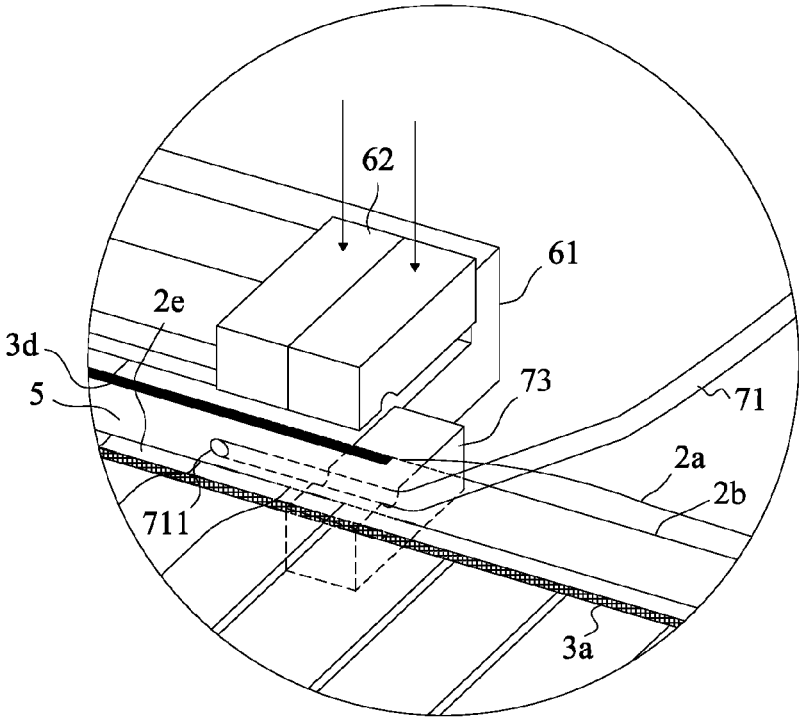
FIGS. 2A to 2D are partly enlarged views, showing the apparatus in operation of the first embodiment according to the present invention.
Figure 2B:
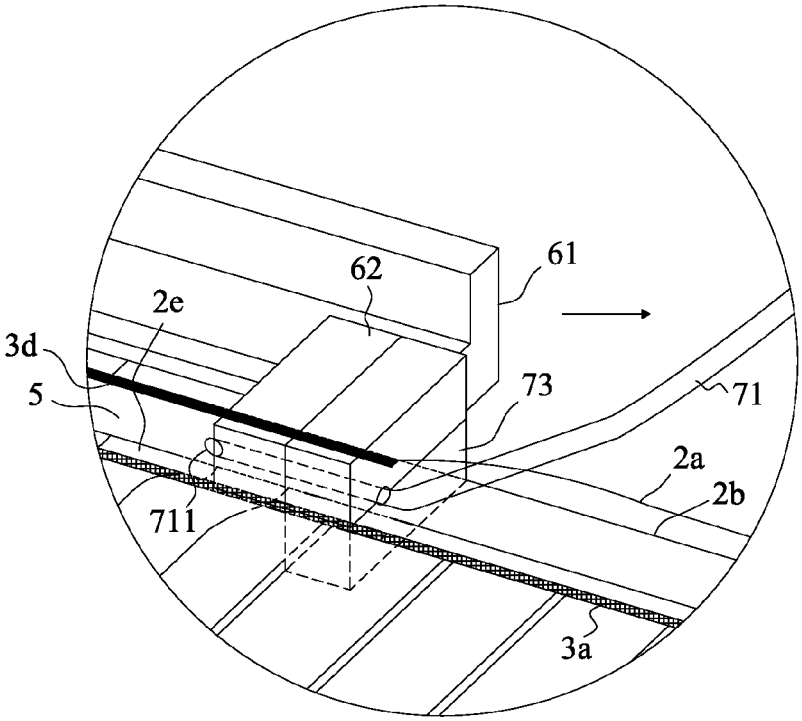
Figure 2C:
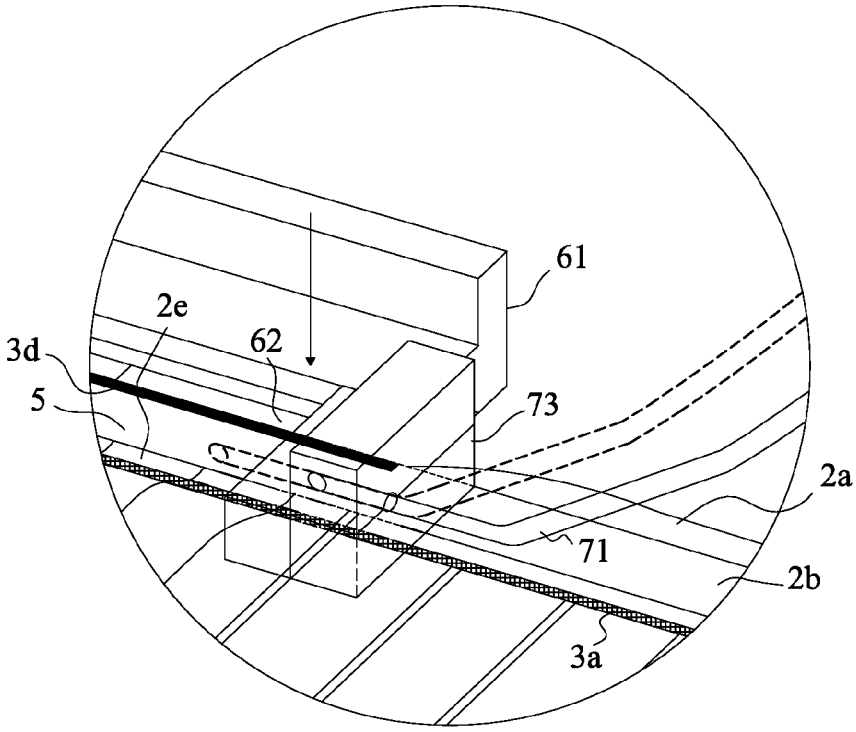
Figure 2D:
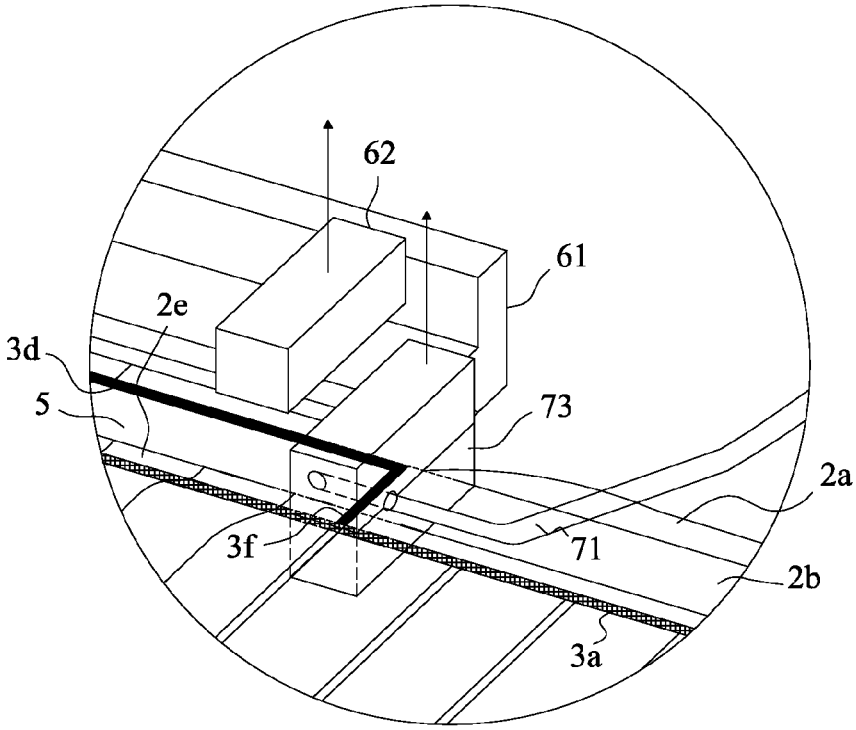

Please refer to FIGS. 1, 2A to 2D. FIG. 1 is a perspective view, showing an apparatus for filling a continuous air filling type air enclosure with air, of a first preferred embodiment according to the present invention. FIGS. 2A to 2D are partly enlarged views, showing the apparatus in operation of the first embodiment according to the present invention.

An apparatus for filling a continuous air filling type air enclosure comprises an air cylinder film sheet 2, an air filling module 7, a clamping apparatus 73 and a working platform 6.

Two sheets of outer film 2*a* and 2*b* are stacked together vertically.

Hot sealing is carried out along hot sealing lines 3*a*, 3*b*, 3*c* and 3*d* so as to adhere the two sheets of outer film 2*a* and 2*b* to each other to form a plurality of air storable air cylinders 20 and a plurality of air inlets 2*e* on one end of the plurality of air cylinders 20, where each air inlet 2*e* corresponds to each air cylinder 20.

Working platform 6 is used for mounting air cylinder film sheet 2 to carry out the hot sealing process. A first hot sealing seat 61 and a second hot sealing seat 62 are mounted on working platform 6. The first hot sealing seat carries out hot sealing along hot sealing lines 3*d* and 3*e* so as to adhere the two sheets of outer film 2*a* and 2*b* to each other and form an air filling passageway 5 at one side of the plurality of air cylinders 20, where air filling passageway 5 is connected with air cylinders 20 through air inlets 2*e*. Furthermore, the second hot sealing carries out hot sealing along hot sealing line 3*f* so as to adhere the two sheets of outer film 2*a* and 2*b* to each other to seal air filling passageway 5.

Air filling module 7 comprises air filling head 71 provided with inclined guide face 711 used for guiding the two sheets of outer film 2*a* and 2*b* to pull apart outward to open air filling passageway 5, allowing air filling head 71 to penetrate into air filling passageway 5 in order to fill air filling passageway 5. In addition, air filling module 7 further comprises compressor 72 used for supplying the air needed for the air filling process.

Clamping apparatus 73 is provided with upper and lower parts respectively disposed at upper and lower sides of air filling head 71, used for pressing the two sheets of outer films 2*a* and 2*b* tightly to allow the plurality of air filling head 71 to be positioned in air filling passageway 5, formed by the two sheets of outer film 2*a* and 2*b* to close air filling passageway 5 and prevent air escaping.

An apparatus for filling a continuous air filling type air enclosure with air disclosed by the present invention may further comprise furling wheel 81 and conveying rollers 82, where furling wheel 81 is used for rolling up the air cylinder film sheet 2 when not filled with air, not expanded and not hot-sealed to form air filling passageway 5, and conveying rollers 82 are used to convey air cylinder film sheet 2 rolled up on furling wheel 81 to working platform 6 for processing.

In addition, the present invention further comprises sensor 91 and vibrator 92, in which the sensor is disposed on working platform 6 and used for detecting the displacement volume of air cylinder film sheet 2, and vibrator 92 is mounted on working platform 6 and used for patting the plurality of air cylinders 20, enabling each air cylinder 20 to be filled with air uniformly.

When the air filling process is carried out, inclined guide face 711 of air filling head 71 first guides the two sheets of outer film 2*a* and 2*b* so that they pull apart outwards, allowing air filling head 71 to move to a place between the two sheets of outer film 2*a* and 2*b*, and the first hot sealing seat 61 is then used to hot-seal the two sheets of outer film 2*a* and 2*b* along the hot sealing lines 3*d* and 3*e* so as to form air filling passageway 5 at one side of the plurality of air cylinders 20. After air filling passageway 5 is formed, the second hot sealing seat 62 and the clamping apparatus 73 are lowered down simultaneously, and the clamping apparatus 73 is used to press the two sheets of outer film 2*a* and 2*b* tightly to allow the two sheets of outer film 2*a* and 2*b* to be attached tightly onto a surface of air filling head 71. Thereafter, air in compressor 72 is filled into air filling passageway 5, and air in air filling passageway 5 opens sequentially each air inlet 2*e* connected with air filling passageway 5 and is filled into air cylinders 20 to cause them to be filled with air and expanded via the air passageways 14.

After the air filling is completed, air filling head 71 is moved rearward to withdraw from air filling passageway 5 and in the meantime, the second hot sealing seat 62 is lowered down to carry out hot sealing along hot sealing line 3*f* so as to adhere the two sheets of outer film 2*a* and 2*b* to each other to seal air filling passageway 5 to prevent the air in the air cylinders from leaking.

Figure 3A:
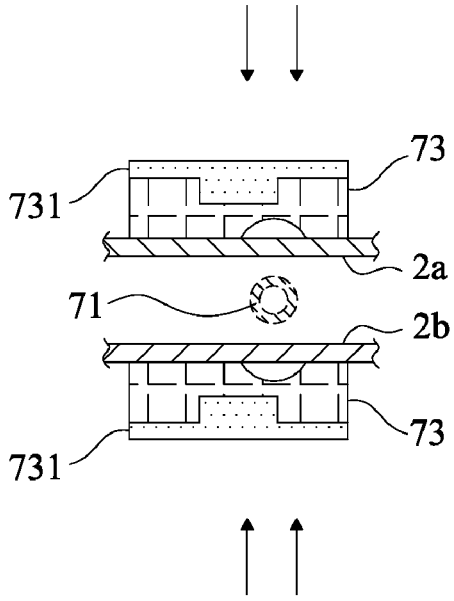
FIGS. 3A and 3B are partly enlarged views, respectively showing actions of a clamping apparatus of a second preferred embodiment according to the present invention.
Figure 3B:
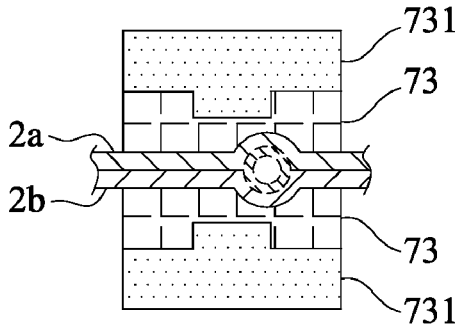

Please refer to FIGS. 3A and 3B. FIGS. 3A and 3B are partly enlarged views, respectively showing actions of a clamping apparatus of a second preferred embodiment according to the present invention.

In this embodiment, the clamping apparatus 73 may further be disposed with an air inflation shaft 731. When air is filled into air inflation shaft 731 to cause it to be filled with air and expanded, the two sheets of outer film 2*a* and 2*b* are pressed tightly to cause the two sheets of outer film 2*a* and 2*b* to be attached tightly onto the surface of air filling head 71. After air cylinder 20 is filled with air and expanded, the air in air inflation shaft 731 can be drained out to loose the two sheets of outer film 2*a* and 2*b* to allow the two sheets of outer film to be loosened from the surface of air filling head 71.

Figure 4:
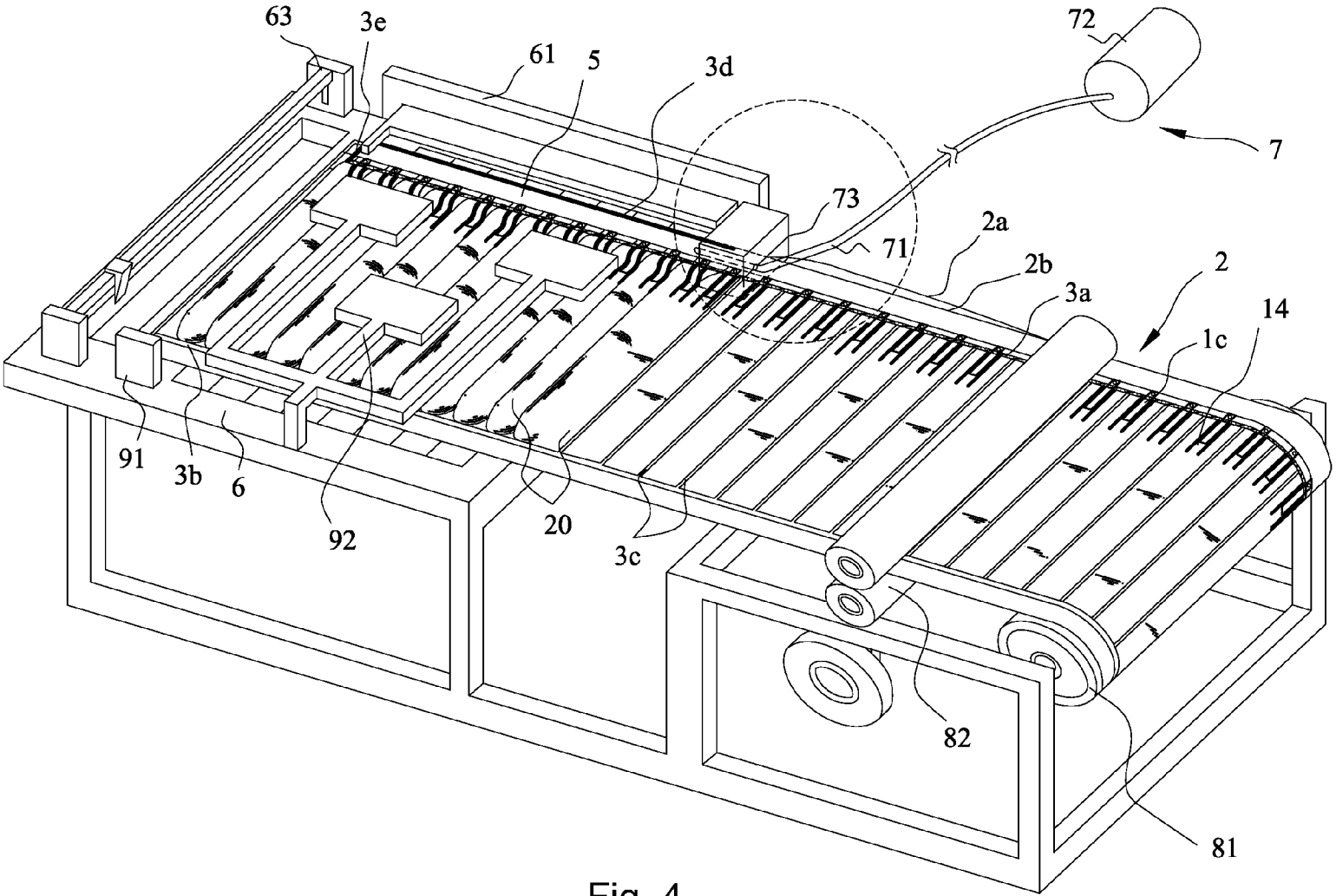
FIG. 4 is a perspective view, showing an apparatus for filling a continuous air filling type air enclosure with air of a third preferred embodiment according to the present invention.
Figure 5A:
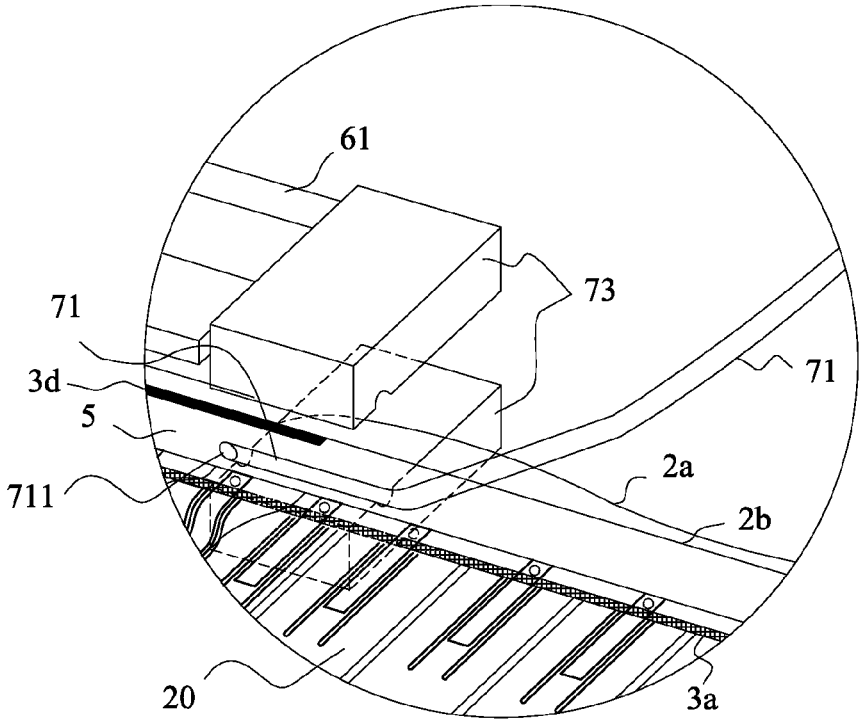
FIGS. 5A and 5B are partly enlarged views, respectively showing actions of a clamping apparatus of the third preferred embodiment according to the present invention.
Figure 5B:
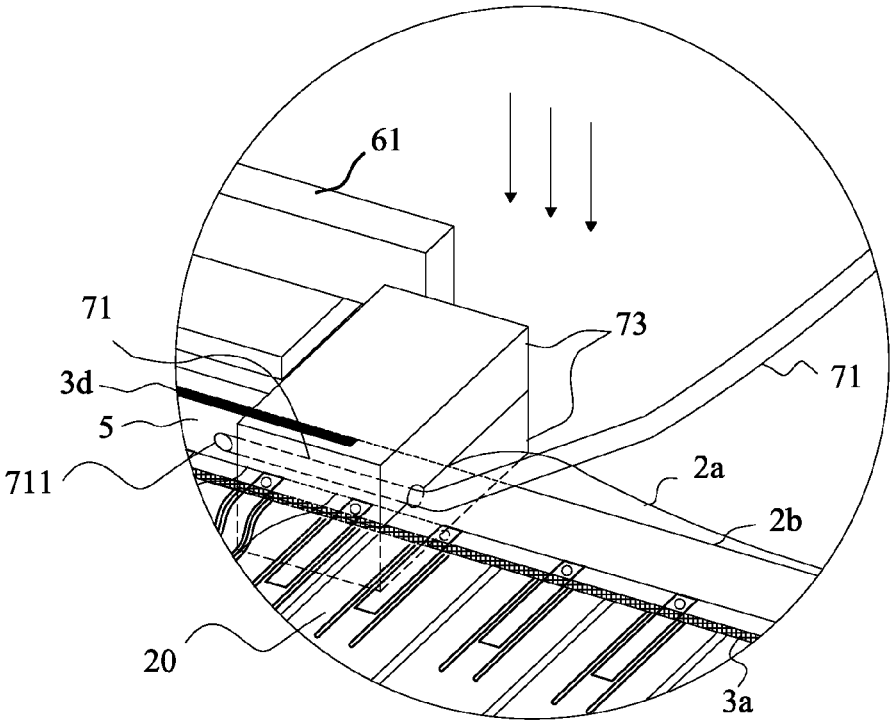
Figure 6A:
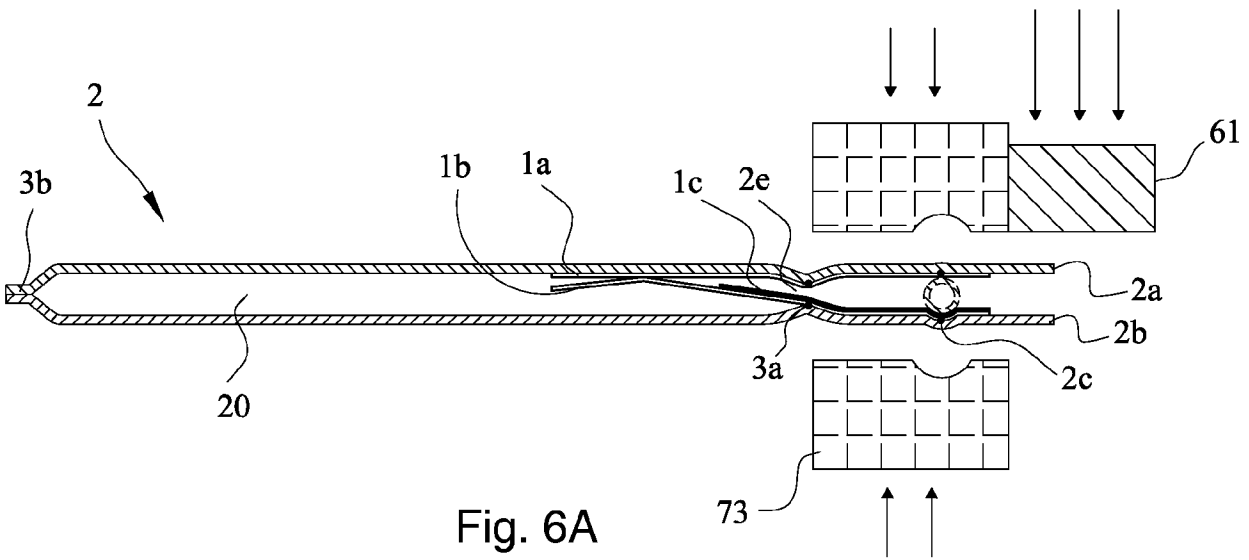
FIGS. 6A to 6C are cross sectional views, respectively showing the air filling apparatus of the third preferred embodiment according to the present invention in different states during the air filling process.
Figure 6B:
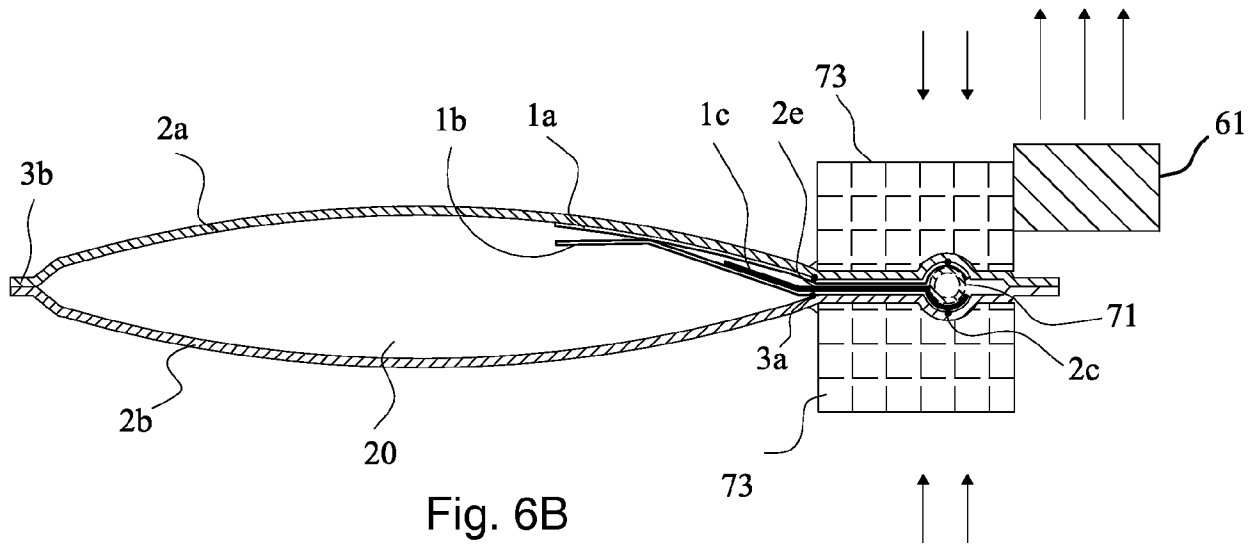
Figure 6C:
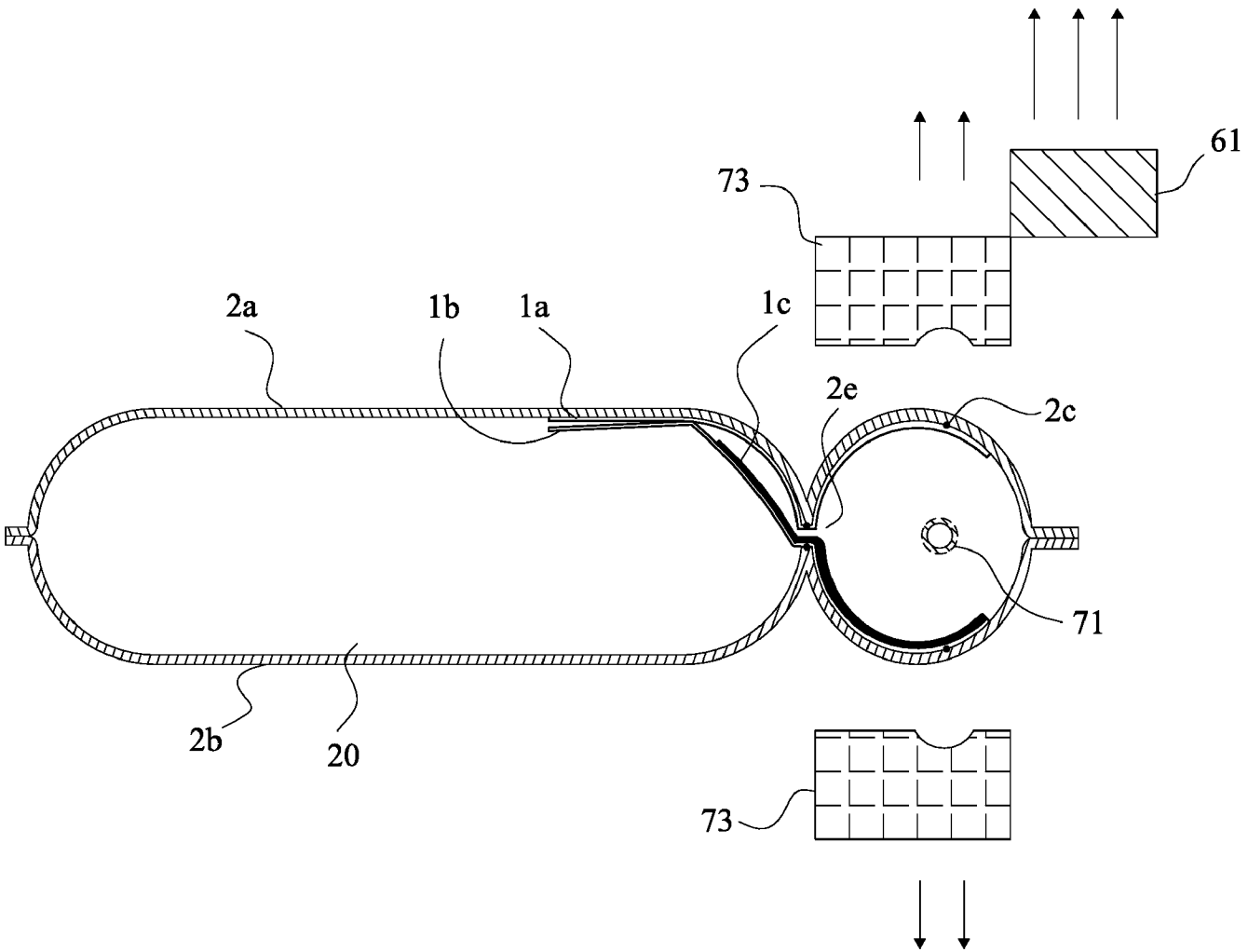

Please refer to FIGS. 4, 5A, 5B and 6A to 6C. FIG. 4 is a perspective view, showing an apparatus for filling a continuous air filling type air enclosure with air of a third preferred embodiment according to the present invention. FIGS. 5A and 5B are partly enlarged views, respectively showing actions of a clamping apparatus of the third preferred embodiment according to the present invention. FIGS. 6A to 6C are cross sectional views, respectively showing the air filling apparatus of the third preferred embodiment according to the present invention in different states during the process of air filling.

An apparatus for filling a continuous air filling type air enclosure with air comprises air cylinder film sheet 2, air filling module 7, clamping apparatus 73 and working platform 6.

Air cylinder film sheet 2 comprises two sheets of outer film 2*a* and 2*b*, two sheets of inner film 1*a* and 1*b*, a plurality of air cylinders 20 and a plurality of air inlets 2*e*.

The two sheets of outer film 2*a* and 2*b* are stacked together vertically.

The two sheets of inner film 1*a* and 1*b* are laid between the two sheets of outer film 2*a* and 2*b*, and the two sheets of inner film 1*a* and 1*b* are placed slightly below the inside top of the two sheets of outer film 2*a* and 2*b*. In addition, heat resistant material 1*c* is spread between the two sheets of inner film 1*a* and 1*b* as an air passable passageway.

Hot sealing is carried out along hot lines 3*a*, 3*b* and 3*c* so as to adhere the two sheets of outer film 2*a* and 2*b* to each other as well as the two sheets of inner film 1*a* and 1*b* to each other, to form the plurality of air storable air cylinders 20 between the two sheets of outer film 2*a* and 2*b*. Furthermore, hot sealing is used to generate hot sealing points 2*c* so as to adhere outer film 2*a* and inner film 1*a* to each other as well as outer film 2*b* and inner film 1*b* to each other. After heat resistant material 1*c* is spread between the two sheets of inner films 1*a* and 1*b*, they are not adhered to each other even by hot sealing to form a plurality of air inlets 2*e* between the two sheets of inner film 1*a* and 1*b*, and each air inlet 2*e* is connected to each air cylinder 20.

According to the air cylinder film sheet 2 disclosed by the present invention, each air inlet 2*e* is connected to air passageway 14, in which air passageway 14 is formed between the two sheets of inner film 1*a* and 1*b* by adhering the two sheets of inner film 1*a* and 1*b* to each other by means of hot sealing, after heat resistant material 1*c* is spread between the two sheets of inner film 1*a* and 1*b*.

Heat resistant material 1*c* is spread sequentially at intervals between the two sheets of inner film 1*a* and 1*b*, for example, by means of heat resistant resin or ink printing. The two sheets of inner film 1*a* and 1*b* are still not adhered to each other to form air inlets 2*e* and air passageways 14.

Air filling module 7 comprises air filling head 71 provided with inclined guide face 711 used for separating the two sheets of outer film 2*a* and 2*b*, allowing air filling head 71 to penetrate air filling passageway 5 in order to fill the passageway with air. In addition, air filling passageway 7 further comprises compressor 72, used to provide the air needed for the air filling process.

Clamping apparatus 73 provided with upper and lower parts respectively mounted at upper and lower sides of air filling head 71, and used for pressing the two sheets of outer films 2*a* and 2*b* to each other tightly to allow the plurality of air filling heads 71 to be positioned in air filling passageway 5, formed by the two sheets of outer film 2*a* and 2*b*, ensuring air filling passageway 5 does not leak.

An apparatus for filling a continuous air filling type air enclosure with air disclosed by the present invention may further comprise furling wheel 81 and conveying rollers 82, where furling wheel 81 is used for rolling up air cylinder film sheet 2 when not filled with air, not expanded and not hot-sealed to form air filling passageway 5, and conveying rollers 82 are used to convey air cylinder film sheet 2 rolled up on furling wheel 81 to working platform 6 for processing.

In addition, the present invention further comprises sensor 91 and vibrator 92, where the sensor is mounted on working platform 6 and used for detecting the displacement volume of air cylinder film sheet 2, and vibrator 92 is mounted on working platform 6 and used for patting the plurality of air cylinders 20 to enable each air cylinder 20 to be filled uniformly with air.

Figure 7A:
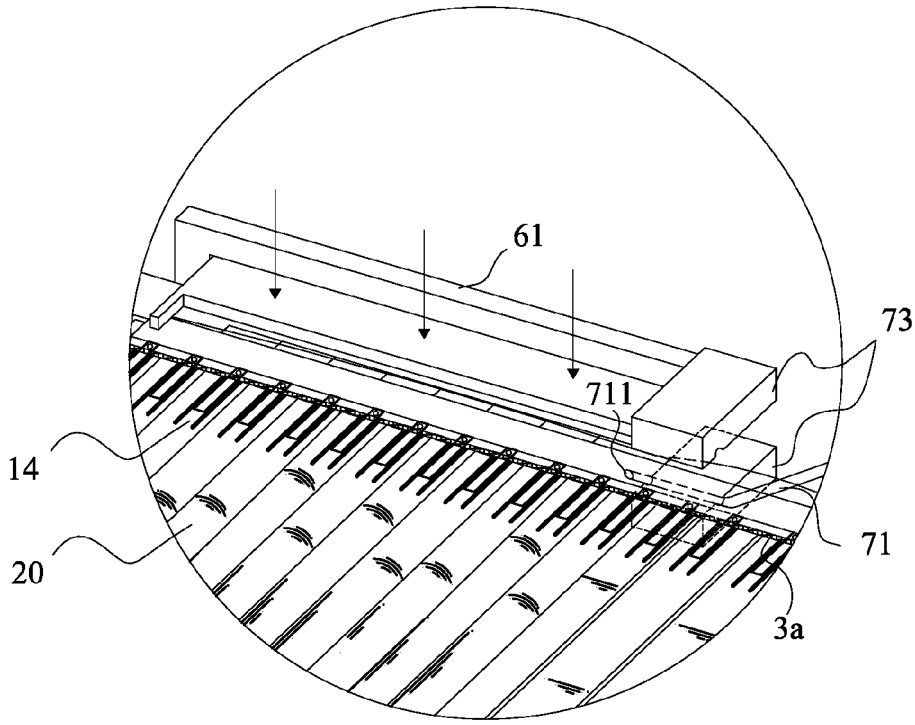
FIGS. 7A and 7B are partly enlarged view, respectively showing an air filling passageway of the third embodiment according to the present invention while being hot-pressed.
Figure 7B:
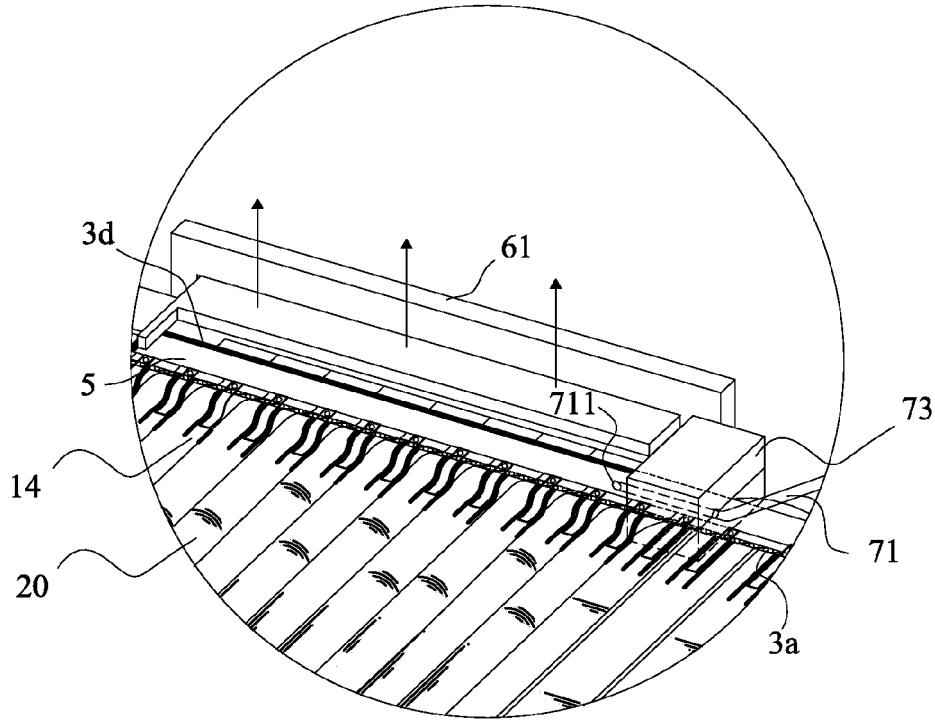

Please refer to FIGS. 7A and 7B. FIGS. 7A and 7B are partly enlarged view, respectively showing an air filling passageway of the third embodiment according to the present invention while being hot-pressed.

When the air filling is carried out, inclined guide face 711 of air filling head 71 first separates the two sheets of outer film 2*a* and 2*b* to allow air filling head 71 to move to a place between the two sheets of outer film 2*a* and 2*b*. The first hot sealing seat 61 is then used to hot-seal the two sheets of outer film 2*a* and 2*b* along hot sealing lines 3*d* and 3*e*, so as to form air filling passageway 5 at one side of the plurality of air cylinders 20. After air filling passageway 5 is formed, clamping apparatus 73 is lowered to press the two sheets of outer film 2*a* and 2*b* tightly, attaching the two sheets of outer film 2*a* and 2*b* firmly to the surface of air filling head 71. Thereafter, air in compressor 72 is then pumped into air filling passageway 5 to cause the two sheets of outer film 2*a* and 2*b* to separate, whilst the two sheets of inner film 1*a* and 1*b* are forced apart through hot sealing points 2*c* so as to open each air inlet 2*e* connected by air filling passageway 5 to enable the air in air filling passageway 5 to be filled into air cylinder 20 to cause it to be filled with air and expanded via the air passageway 14.

After air cylinders 20 are filled with air and expanded, the internal air pressure of each air cylinder 20 compresses the two sheets of inner film 1*a* and 1*b* in order to attach it firmly to the outer film 2*a* or 2*b*, covering air passageway 14 and shielding each air cylinder 20 to prevent the air in air cylinder 20 leaking. This way, if there is damage to any air cylinder 20, the structure disclosed by the present invention can prevent air in other air cylinders 20 from being leaked out, and maintain the bag's shock absorbing effect.

In the description mentioned above, after air cylinder 20 is filled with air and expanded, the two sheets of inner film 1*a* and 1*b* may be compressed by the air in air cylinder 20 to cover air passageway 14, instead of attached to the side of the outer film 2*a* or 2*b* to shield each air cylinder 20, in order to prevent the air in air cylinder 20 from leaking.

After parts of air cylinders 20 of the air cylinder film sheet 2 are filled with air and expanded, air cylinder film sheet 2 starts to move, causing the air-filled and expanded air cylinders 20 to separate from working platform 6, and causing the empty and unexpanded air cylinders to enter working platform 6. Meanwhile, sensor 91 is used to detect the displacement volume of air cylinder film sheet 2 to ensure the displacement volume of detected air cylinder film sheet 2 is neither too great nor so little as to be unable to carry out continuously the air filling process of empty and unexpanded air cylinders 20. This reduces air filling time by maintaining continuous air pressure, and reduces the time consumed by the entire process, lowering the production cost of the air enclosure.

A structure disclosed by the present invention further comprises cutting seat 63 disposed on one side of working platform 6 (see FIGS. 1 and 4). When the air-filled and expanded air cylinders 20 leave working platform 6, cutting may be carried out between air cylinders 20 to allow the air-filled and expanded air cylinders to be used independently.

The description mentioned above is to be understood as explaining that air filling head 71 is first moved to a place between the two sheets of outer film 2*a* and 2*b*, and then the first hot sealing seat 61 is then used to hot-seal the two sheets of outer film 2*a* and 2*b* to form air filling passageway 5. However, it may also be that the two sheets of outer film 2*a* and 2*b* are first adhered to each other through the first hot sealing seat 61 to form air filling passageway 5 and air filling head 71 is then moved into air filling passageway 5. The air enclosure manufacturing process disclosed by the present invention is therefore not limited to this description.

Figure 8:
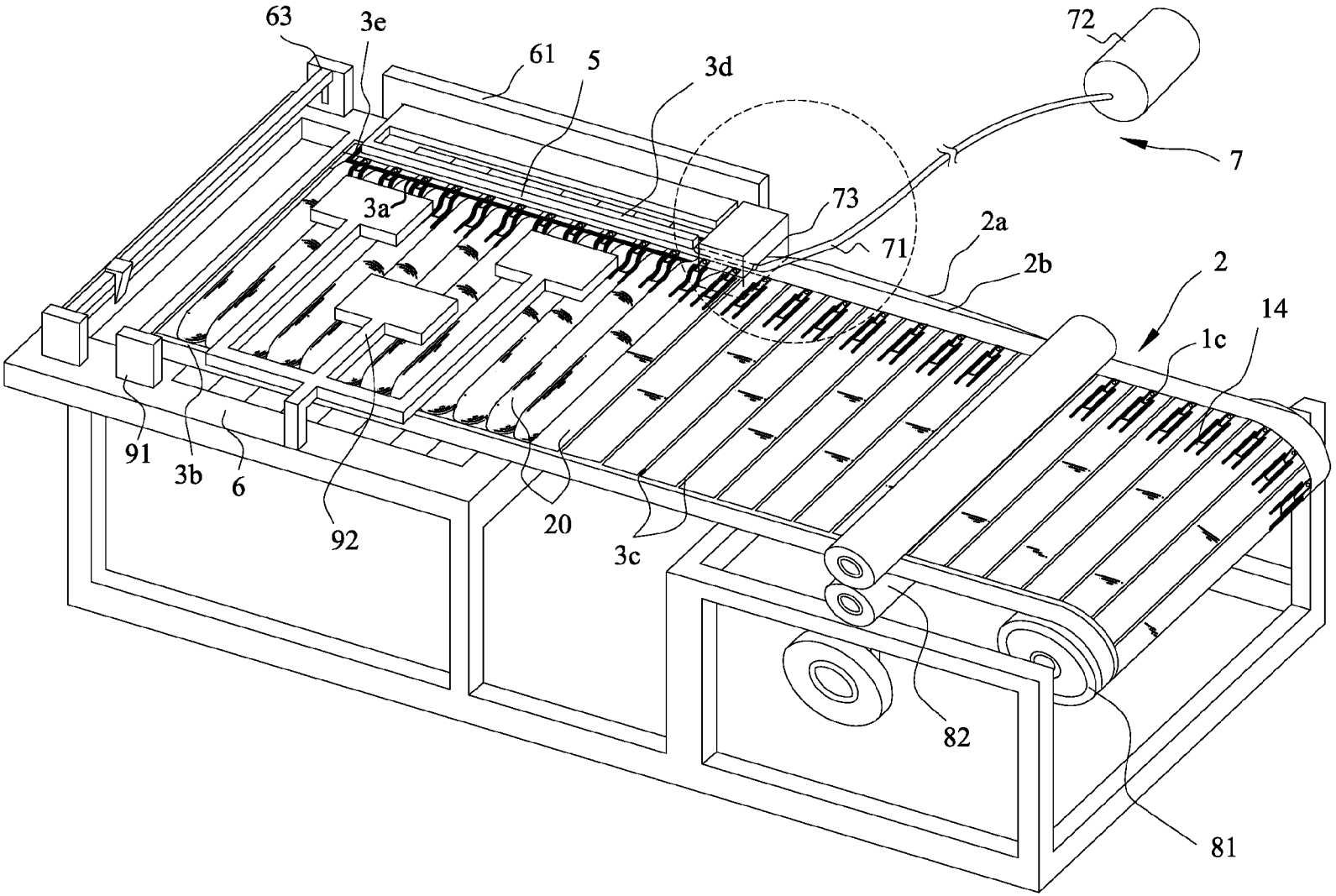
FIG. 8 is a perspective view, showing an air filling apparatus of a fourth preferred embodiment according to the present invention.

Please refer to FIG. 8. FIG. 8 is a perspective view, showing an air filling apparatus of a fourth preferred embodiment according to the present invention.

If air cylinder film sheet 2 is not hot-sealed along hot sealing liner 3*a*, the first hot sealing seat 61 can be made U-shaped and hot sealing is carried out along the hot sealing lines 3*a*, 3*d* and 3*e* so as to hot-seal the two sheets of outer film 2*a* and 2*b* to form air filling passageway 5 at one side of the plurality of air cylinders.

Figure 9:
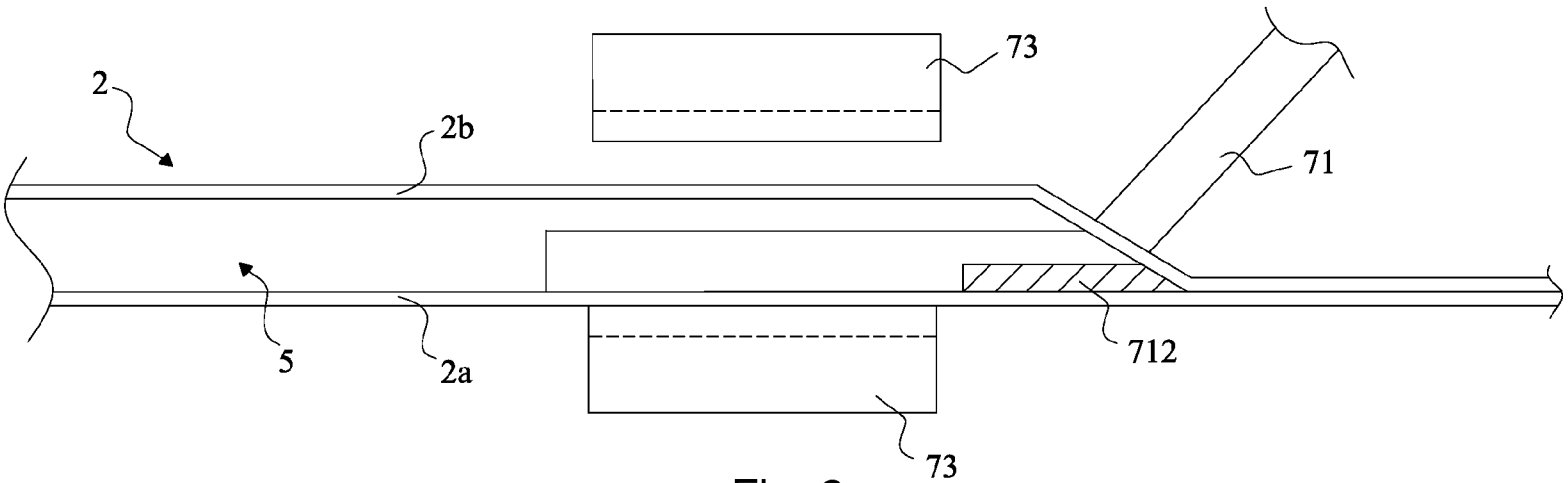
FIG. 9 is a schematic view, showing a cutting action of a cutting knife of a fifth preferred embodiment according to the present invention.
Figure 10:
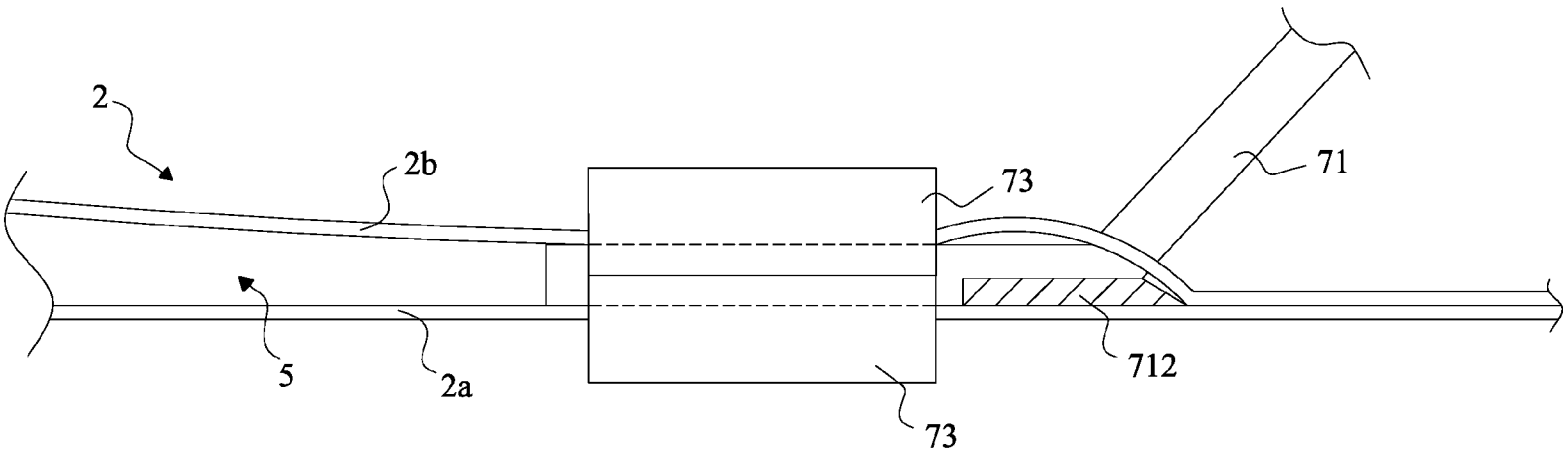
FIG. 10 is a schematic view, showing another cutting action of a cutting knife of the fifth embodiment according to the present invention.

Please refer to FIGS. 9 and 10. FIG. 9 is a schematic view, showing a cutting action of a cutting knife of a fifth preferred embodiment according to the present invention. FIG. 10 is a schematic view, showing another cutting action of a cutting knife of the fifth embodiment according to the present invention.

In this embodiment the filling apparatus further comprises cutting knife 712 positioned at one side of air filling head 71, and the direction used by cutting knife 712 to cut the two sheets of outer film 2*a* and 2*b* is opposite to the direction for air filling head 71 to fill air filling passageway 5; this is also means that the direction used b cutting knife 712 to cut the two sheets of outer film 2*a* and 2*b* is opposite to the direction of in which air cylinder film sheet 2 is conveyed, and the direction for air filling head 71 to fill the air passageway 5 is the same as the direction in which air cylinder film sheet 2 is conveyed. If air cylinder film sheet 2 is hot-sealed along hot sealing line 3*d* in advance, the two sheets of outer film 2*a* and 2*b* are first separated by cutting along the hot sealing line 3*d* through the cutting knife 712 while being filled with air, to allow air filling head 71 to be moved between the two sheets of outer film 2*a* and 2*b*. Next, clamping apparatus 73 is used to compress the two sheets of outer film 2*a* and 2*b* tightly, enabling the two sheets of outer film 2*a* and 2*b* to be attached firmly to the surface of air filling head 71 in order to carry out the air filling process.

Figure 11:
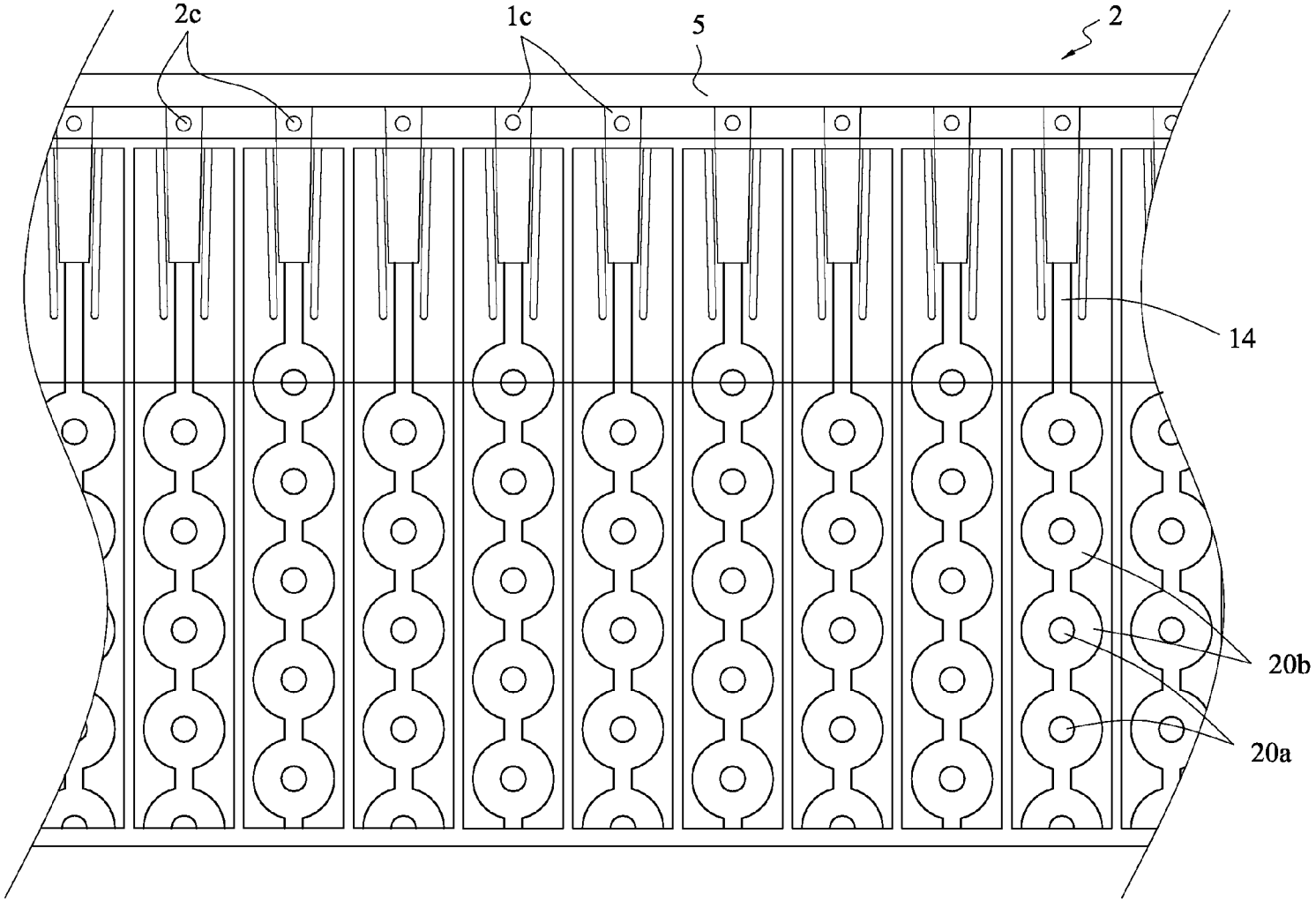
FIG. 11 is a plane view, showing an air enclosure of a sixth preferred embodiment according to the present invention before air filling.
Figure 12:
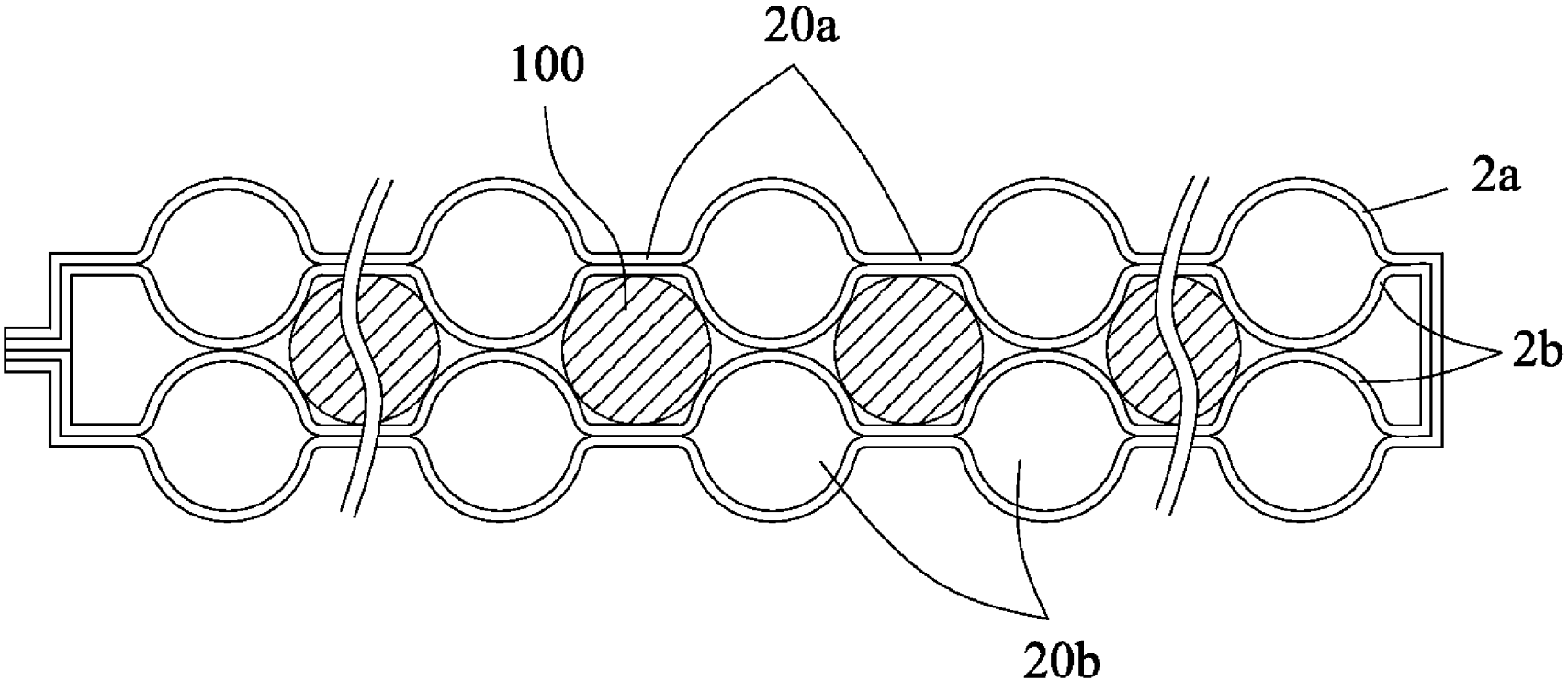
FIG. 12 is a cross sectional view, showing an article placed in the air enclosure of the sixth preferred embodiment according to the present invention after the air filling process.
Figure 13:
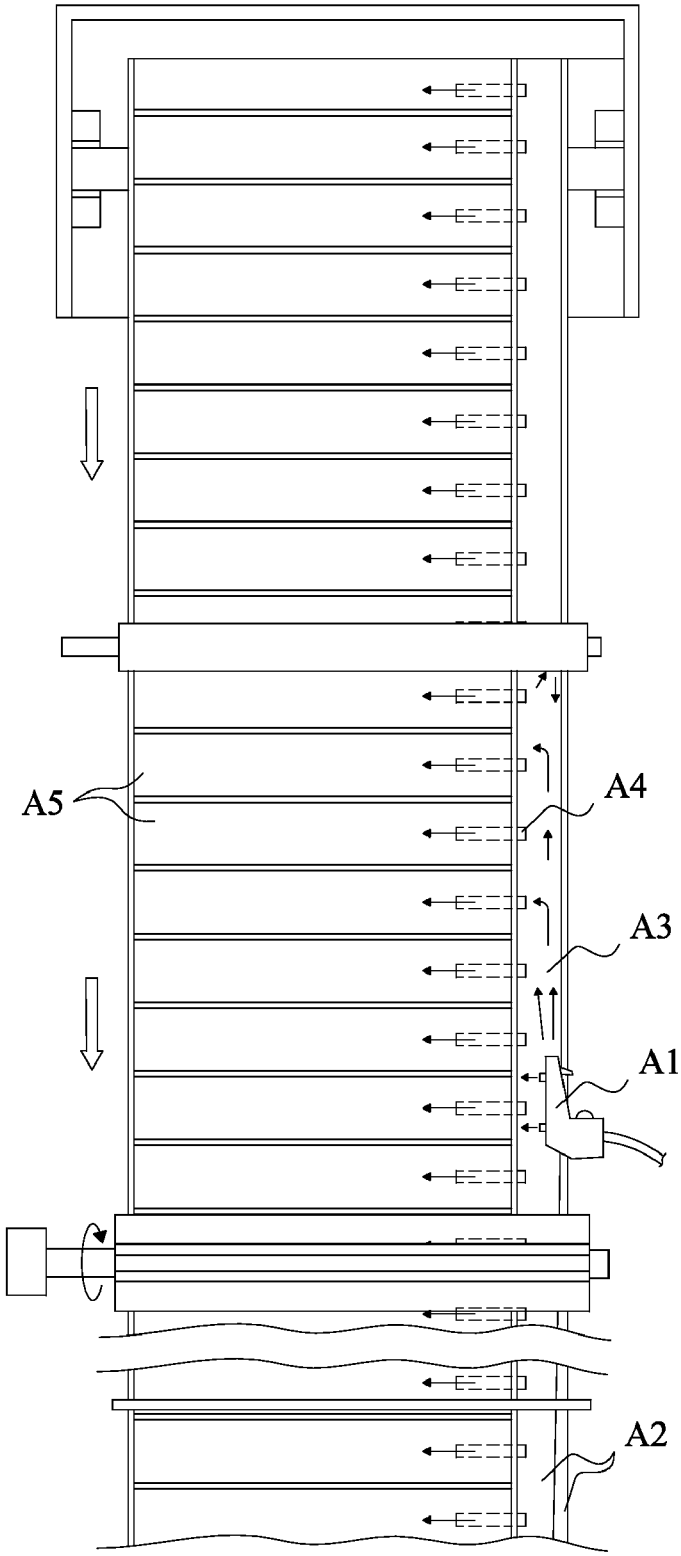
Fig. 13 (Prior Art)
FIG. 13 is a schematic view of a conventional air filling apparatus.
Figure 14:
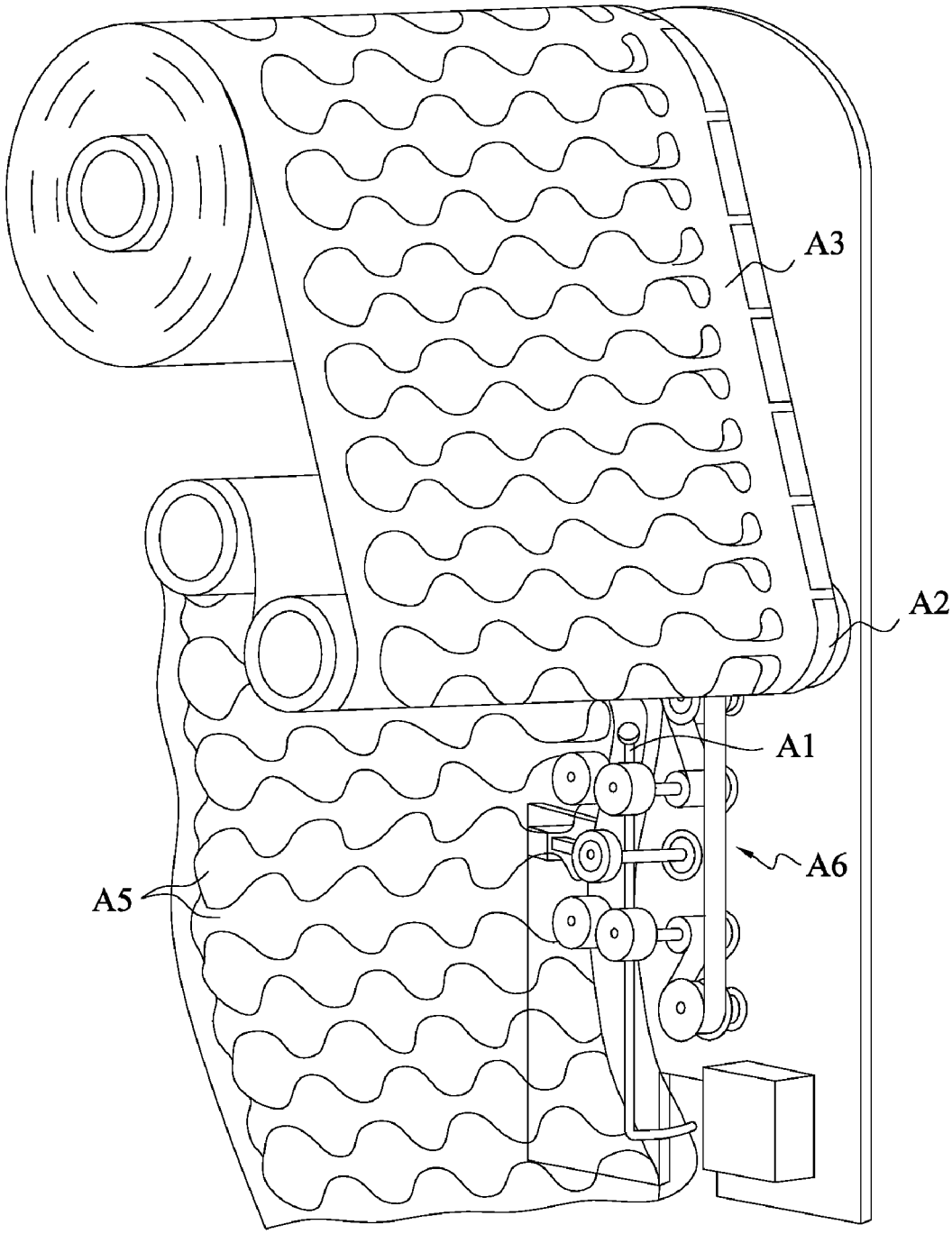
Fig. 14 (Prior Art)
FIG. 14 is a schematic view of another conventional air filling apparatus.

Please refer to FIGS. 11 and 12. FIG. 11 is a plane view, showing an air enclosure of a sixth preferred embodiment according to the present invention prior to it being filled with air. FIG. 12 is a cross sectional view, showing an article placed in the air enclosure of the sixth preferred embodiment according to the present invention subsequent to it being filled with air.

An air filling apparatus disclosed by the present invention further comprises at least one hot pressing node 20*a* and at least one circular loop portion 20*b* positioned on air cylinders 20, in which hot pressing node 20*a* is formed by adhering the two sheets of outer film 2*a* and 2*b* to each other by means of hot sealing, and each circular loop portion 20*b* is wrapped around each pressing node 20*a*. In addition, circular loop portions 20*b* placed on the two adjacent air cylinders 20 are interlaced and not connected to each other, but each circular loop portion 20*b* of the identical air cylinder 20 is connected with each other. Therefore, each circular loop portion 20*a* placed on air cylinder 20 is filled with air and expanded with air cylinder 20 when air cylinder 20 is filled with air and expanded. When the air-filled and expanded air cylinders 20 are bent (air cylinders 20 may also first bent prior to the air filling process being carried out), article 100 may be placed under hot pressing nodes 20*a*. Article 100 is then wrapped by the circular loop portions 20*b*; it not only prevents article 100 from being shaken inside air enclosure 1, but also strengthens the cushioning protection of article 100.

A method for filling a continuous air filling type air enclosure with air, comprising the follow steps:

Step 1: supplying air cylinder film sheet 2.

Two sheets of outer film 2*a* and 2*b* are first stacked together to cause two sheets of inner film 1*a* and 1*b* to be laid in between the two sheets of outer film 2*a* and 2*b*. The two sheets of outer film 2*a* and 2*b* are then adhered to each other by means of hot sealing to form air cylinder film sheet 2, in which a plurality of air cylinders 20 are formed between the two sheets of outer film 2*a* and 2*b*, a plurality of air inlets 2*e* are formed on one end of the plurality of air cylinders 20, and each air inlet 2*e* corresponds to each air cylinder 20.

When the two sheets of outer film 2*a* and 2*b* are adhered to each other by means of hot sealing, the two sheets of inner films 1*a* and 1*b* are simultaneously adhered to each other and form the pair of air inlets 2*e* by means of hot sealing to avoid the two sheets of inner film 1*a* and 1*b* adhering to other films Hot sealing is carried out along hot sealing lines 3*a*, 3*b* and 3*c* so as to adhere the two sheets of outer film 2*a* and 2*b* to each other and the two sheets of inner film 1*a* and 1*b* to each other to form the plurality of air storable air cylinders 20 between the two sheets of outer film 2*a* and 2*b*. Furthermore, after heat resistant material 1*c* is spread between the two sheets of inner film 1*a* and 1*b*, the two sheets of inner film 1*a* and 1*b* are not adhered to each other by hot sealing, so the pair of air inlets 2*e* is formed between the two sheets of inner film 1*a* and 1*b*.

In addition, each air inlet 2*e* is connected to air passageway 14, where the two sheets of inner film 1*a* and 1*b* are adhered to each other by means of hot sealing to form between the two sheets of inner film 1*a* and 1*b* after the heat resistant material 1*c* is spread between the two sheets of inner film 1*a* and 1*b*.

Step 2: moving the air cylinder film sheet 2 to working platform 6.

After the manufacture of air cylinder film sheet 2 is complete, it is first rolled up on furling wheel 81, and air cylinder film sheet 2 rolled up on furling wheel 81 is conveyed to working platform 6 through conveying rollers 82.

Step 3: moving air filling head 71 between the two sheets of outer film 2*a* and 2*b*.

After the air cylinder film sheet 2 is conveyed to working platform 6, inclined guide face 711 of air filling head 71 may first guide the two sheets of outer film 2*a* and 2*b* to pull apart outward to enable air filling head 71 to be placed between the two sheets of outer film 2*a* and 2*b*.

In addition, if hot sealing is carried out on the air cylinder film sheet 2 along the hot sealing line 9*d* in advance, the two sheets of outer film 2*a* and 2*b* are caused to separate by cutting along the hot sealing line 2*d* first with cutting knife 712 to allow air filling head 71 to be placed between the two sheets of outer film 2*a* and 2*b*.

Step 4: adhering the two sheets of outer film 2*a* and 2*b* by means of hot sealing to form air filling passageway 5 at one side of air cylinders 20, air filling passageway 5 being connected with air cylinders 20 through air inlets 2*e*.

Hot sealing is carried out along hot sealing lines 3*d* and 3*e* by the first hot sealing seat 61 so as to adhere the two sheets of outer film 2*a* and 2*b* by means of hot sealing to form air filling passageway 5 at one side of the plurality of air cylinders 20.

If hot sealing is not carried out on air cylinder film sheet 2 along the hot sealing line 2*a* in advance in Step 2, the first hot sealing seat 61 may also be used to carry out hot sealing along hot sealing line 3*a*.

According to the description mentioned above, the first hot sealing seat 612 is first used to hot-seal the two sheets of outer film 2*a* and 2*b* to form air filling passageway 5 and air filling head 71 is then moved into air filling passageway 5. However, air filling head 71 may also be first placed between the two sheets of outer film 2*a* and 2*b* and the first hot sealing seat 61 then used to hot-seal the two sheets of outer film 2*a* and 2*b* to form air filling passageway 5.

Step 5: providing a clamping apparatus 73 to press the two sheets of outer film 2*a* and 2*b* tightly to attach onto air filling head 71.

Step 6: filling air cylinder 20 with air continuously via air inlet 2*e*.

Air filling head 71 is used to fill air filling passageway 5 with air in a compressor 72, the air in air filling passageway 5 opens each air inlet 2*e* connected with air filling passageway 5 in sequence and is pumped into air cylinder 20 causing it to be filled with air and expanded via air passageway 14.

If two sheets of inner film 1*a* and 1*b* are placed on air cylinder film sheet 2, the air in air cylinder 20 compresses the two sheets of inner film 1*a* and 1*b* to cover the air inlet 2*e* to shield air cylinder 20. If the two sheets of inner film 1*a* and 1*b* are not placed on air cylinder film sheet 2, a second hot sealing seat 62 may be used to carry out hot sealing along hot sealing line 3*f* so as to adhere the two sheets of outer film 2*a* and 2*b* to each other to shield air filling passageway 5.

In addition, vibrator 92 may also be used to pat the plurality of air cylinders 20 when the air filling is being carried out to enable each air cylinder 20 to be filled uniformly with air.

Step 7: moving the air-filled air cylinders 20 to leave working platform 6.

When the air-filled and expanded air cylinder 20 leaves working platform 6, sensor 91 is used to detect the displacement volume of air cylinder film sheet 2 simultaneously so as to ensure the displacement volume of detected air cylinder film sheet 2 is neither too great nor so little as to be unable to carry out continuously the air filling process, and cutting seat 63 may be used to carry out cutting between air cylinders 20 to enable the air-filled and expanded air cylinders 20 to be used independently.

Furthermore, a method disclosed by the present invention may further comprise moving air-unfilled air cylinders 20 onto working platform 6, and the first hot sealing seat 61 is then used to hot-seal the two sheets of outer film 2*a* and 2*b* to form air filling passageway 5 to enable filling head 71 to be positioned in air filling passageway 5.

In addition, a method disclosed by the present invention may comprise hot-sealing the two sheets of outer film 2*a* and 2*b* to form hot pressing nodes 20*a* on air cylinders 20 and circular loop portion 20*b* outside each hot pressing node 20*a*; each circular loop portion 20*b* is wrapped around each hot pressing node 20*a*. When air cylinders 20 are filled with air and expanded, article 100 is lodged in hot pressing nodes 20*a* and wrapped by hot pressing nodes 20*b*. In addition, each circular loop portion 20*b* on air cylinder 20 is connected with another. Therefore, when air cylinder 20 is filled with air and expanded, each circular loop portion 20*b* placed thereon is filled with air and expanded with air cylinder 20.

No matter if air cylinder film sheet 2 is positioned with two sheets of inner film 1*a* and 1*b* or not, the air filling apparatus disclosed by the present invention can carry out the air filling process, and in the event that air cylinder film sheet 2 is not positioned with air filling passageway 5, air filling passageway 5 may be fabricated on the air cylinder film sheet 2 to allow the plurality of air cylinders 20 to be filled with air continuously so as to reduce air filling time, overcoming the problem of filling each air cylinder (as is the case with conventional air packing bags), and decreasing the labor cost consumed during the air filling process. In addition, the present invention allows the two sheets of outer film 2*a* and 2*b* to be attached to the surface of air filling head 71 tightly while carrying out the air filling process so as to prevent air from leaking, thus increasing the air filling efficiency. Moreover, hot sealing temperatures of the first hot sealing seat 61 and the second hot sealing seat 62 of the present invention may all be adjusted so that they can be used on different materials of the two sheets of outer film 2*a* and 2*b* as well as the two sheets of inner film 1*a* and 1*b*. Furthermore, the apparatus disclosed by the present invention may effectively fill air cylinders 20 with air, and prevents the air leaking; this not only allows the air enclosure to sustain greater shock but also prevents the whole air packing bag from leaking when one air cylinder is damaged.

Additional advantages and modifications will readily occur to those proficient in the relevant fields. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An apparatus for filling a continuous air filling type air enclosure with air, used for carrying out an air filling process using an air cylinder film sheet, the air cylinder film sheet comprising two outer films, a plurality of air cylinders and a plurality of air inlets, the plurality of air cylinders being formed by adhering the two outer films by means of hot sealing, the plurality of air inlets being disposed at one side of the plurality of air cylinders and the each air inlet corresponding to the each air cylinder, the air filling apparatus comprising:

a working platform, to mount the air cylinder film sheet;

a first hot sealing device, mounted on the working platform, to hot-seal the two outer films to form an air filling passageway at one side of the air cylinders, the air filling passageway being connected with the air cylinders through the air inlets;

an air filling head, to fill the air filling passageway with air; and a clamping apparatus, to press the two outer films tightly to attach onto the air filling head, enabling air in the air filling passageway to enter the each air cylinder to cause the each air cylinder to be filled with air and expanded via each air inlet.

2. The apparatus for filling a continuous air filling type air enclosure with air according to claim 1, further comprising a cutting device, cutting being carried out between the air cylinders to enable the air cylinders to be used independently.

3. The apparatus for filling a continuous air filling type air enclosure with air according to claim 1, further comprising a cutting knife disposed at one side of the air filling head, the two outer films being caused to separate by cutting through the cutting knife when the sides of the two outer films of the air cylinder film sheet are adhered to each other by means of hot sealing.

4. The apparatus for filling a continuous air filling type air enclosure with air according to claim 1, further comprising two inner films and a plurality of air passageways, the two inner films being placed between the two outer films, the air inlet being disposed between the two inner films and formed by not adhering the two inner films to other films even by means of hot sealing, each air passageway being connected to the each air inlet and formed by not adhering the two inner films to each other even by means of hot sealing.

5. The apparatus for filling a continuous air filling type air enclosure with air according to claim 1, wherein the air cylinder comprises at least one hot pressing node and at least one circular loop portion, the hot pressing node formed by adhering the two outer films by means of hot sealing, an article is allowed to enter the hot pressing node when the air cylinders are filled with air and expanded, the circular loop portion is put around the hot pressing node, the article is wrapped through the circular loop portion when the article is let in the hot pressing node.

6. The apparatus for filling a continuous air filling type air enclosure with air according to claim 1, wherein the air inlet is positioned between the two outer films and formed by not adhering the two outer films to each other even by means of hot sealing.

7. The apparatus for filling a continuous air filling type air enclosure with air according to claim 1,the air filling head comprises an inclined guide face used for guiding the two outer films to pull apart outward to open the air filling passageway to enable the air filling head to penetrate the air filling passageway.

8. The apparatus for filling a continuous air filling type air enclosure with air according to claim 1, wherein the clamping apparatus comprises an inflation shaft.

9. The apparatus for filling a continuous air filling type air enclosure with air according to claim 1, further comprising a second hot sealing device mounted on the working platform, used for hot-sealing the two outer films to shield the air filling passageway.

10. The apparatus for filling a continuous air filling type air enclosure with air according to claim 1, further comprising a sensor disposed on the working platform, used for detecting the displacement volume of the air cylinder film sheet.

11. The apparatus for filling a continuous air filling type air enclosure with air according to claim 1, further comprising a vibrator mounted on the working platform and used for patting the plurality of air cylinders to cause the plurality of air cylinders to be filled uniformly with air.

* * * * *